United States Patent [19]

Collins, III et al.

[11] 4,017,704

[45] Apr. 12, 1977

[54] INDUCTION HEATING APPARATUS AND METHOD FOR USING THE SAME

[75] Inventors: John W. Collins, III, Allegheny Township, Westmoreland County; E. Scott Douds, Pittsburgh, both of Pa.

[73] Assignee: Aluminum Company of America, Pittsburgh, Pa.

[22] Filed: Apr. 22, 1975

[21] Appl. No.: 570,486

Related U.S. Application Data

[63] Continuation-in-part of Ser. No. 455,559, March 28, 1974, abandoned.

[52] U.S. Cl. ..... 219/10.79; 219/10.43; 219/10.53; 219/10.69; 336/75; 336/232

[51] Int. Cl.[2] ..... H05B 9/02

[58] Field of Search ..... 219/10.53, 10.79, 10.43, 219/10.41, 10.49, 10.69, 9.5; 336/75, 87, 73, 79, 232, 82

[56] References Cited

UNITED STATES PATENTS

| | | | |
|---|---|---|---|
| 392,385 | 11/1888 | Weston | 336/82 |
| 1,790,906 | 2/1931 | Eckman | 336/82 X |
| 2,448,008 | 8/1948 | Baker | 336/75 |
| 2,489,867 | 11/1949 | D'Orio | 336/232 |
| 2,525,438 | 10/1950 | Wuerfel | 336/75 |
| 3,308,412 | 3/1967 | Curtis | 336/87 |
| 3,694,609 | 9/1972 | Kennedy | 219/10.79 |

OTHER PUBLICATIONS

Tudbury Basics of Induction Heating vol. 1, Rider N.Y. 1960 pp. (1–13)(one page only).

*Primary Examiner*—E. A. Goldberg
*Attorney, Agent, or Firm*—David W. Brownlee

[57] ABSTRACT

An elongate copper coil with an open center area has a bow-tie shaped non-magnetic metal core disposed adjacent the center of the coil and insulated from the coil. The coil is adapted to be connected to a high frequency alternating current generator for producing a magnetic field in the area surrounding the coil and core for induction heating metal articles such as can ends which are moved continuously past the apparatus. The core changes the pattern of maximum flux density of the magnetic field produced by the coil to facilitate controlled transfer of heat into and out of the can ends.

11 Claims, 7 Drawing Figures

INDUCTION HEATING APPARATUS AND METHOD FOR USING THE SAME

CROSS-REFERENCE TO RELATED APPLICATIONS

This application is a continuation-in-part of application Ser. No. 455,559, filed Mar. 28, 1974 now abandoned for Induction Heating Apparatus and Method for Using the Same.

BACKGROUND OF THE INVENTION

1. Field of the Art

This invention relates to induction heating and in particular to a method and apparatus for induction heating articles made of sheet metal as they are moved continuously and rapidly past an induction heating coil.

2. Brief Description of the Prior Art

Induction heating metal articles for a variety of purposes such as sealing containers, surface hardening metal parts, brazing, cooking, and curing coatings, among others, is well known. Induction heating involves passing a high frequency alternating current through a copper coil to create magnetic fields or magnetic lines of force in the area surrounding the current carrying conductor coil. When a metal article is placed in the magnetic field, heat is produced in the article as a result of eddy current losses and hysteresis losses (magnetic materials only). The eddy current losses are resistant losses resulting from circulating currents induced in the metal article by virtue of differences in electrical potential at various locations in the metal. This difference in potential is caused by the alternating magnetic fields passing through the metal article.

Heretofore, induction heating of articles made of thin sheet metal has sometimes been unsatisfactory due to non-uniform heating of the articles. It is well known that the eddy current losses which heat an article vary inversely as the square of the distance from the coil conductor. Consequently, various portions of a workpiece will be heated to greatly varying degrees depending on proximity to the coil. Induction heating also produces a so-called "edge effect" phenomenon whereby the edge of a thin sheet of metal will be heated first, generally regardless of its disposition within the magnetic field. Consequently, when a foil disc or can end is positioned in or moved through the magnetic field produced by an induction heating coil, the edge of the article is heated first, and may be overheated, before the center of the article is heated to the desired temperature. When the peripheral edges of a sheet metal article are heated before the center of the article, the edges can be melted or burned off, or the article may be warped due to the non-uniform heating.

Many ideas have been tried for rapidly and uniformly heating an entire sheet metal article, but without much success. For example, sheet metal articles have been rotated as they have been moved past a coil and have been moved through box or stacked coils rather than beneath pancake coils. The patent art is replete with disclosures of methods and apparatus for induction heating of metal articles as is disclosed in U.S. Pat. Nos. 2,479,980, 2,946,168, 3,057,988, 3,548,140, 3,794,802 and Canadian Pat. No. 818,966 among others.

The prior art is lacking in a disclosure of induction heating apparatus and methods in which sheet metal articles can be rapidly heated throughout. The prior art is also lacking in induction heating apparatus and methods for permitting modulation or adjustment of the location of maximum flux intensity of the magnetic field.

SUMMARY OF THE INVENTION

This invention provides an induction heating method and apparatus utilizing a high frequency induction heating coil having a generally open center and an associated core of conductive non-magnetic material disposed adjacent the center of the coil and insulated therefrom.

An object of this invention is to provide an induction heating method and apparatus for controlled heating of sheet metal articles.

Another object of this invention is to provide induction heating apparatus in which the location of the maximum magnetic field intensity can be adjusted.

A further object of this invention is to provide a method and apparatus for progressively inducing a flow of heat energy in a sheet metal article from its outer edge inwardly to its center and then causing the heat energy to flow progressively from its center to the outer edge.

Another object of this invention is to provide an induction heating method and apparatus which will not warp or otherwise damage sheet metal articles which are heated thereby.

Another object of this invention is to provide a method and apparatus for induction heating can ends to soften a coating thereon as the can ends are moved continuously past the induction heating coil.

A further object of this invention is to provide apparatus for heating sheet metal articles with a minimum of power and little or no wasted electrical energy.

The above and other objects and advantages of this invention will be more fully appreciated and understood with reference to the following description and the drawings appended hereto.

DESCRIPTION OF PREFERRED EMBODIMENT

Figure 1:
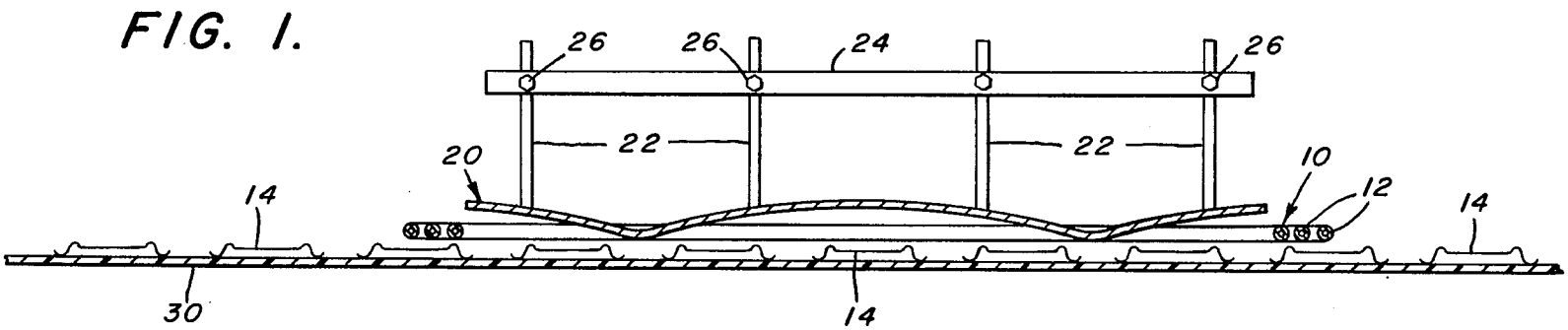
FIG. 1 is a cross-sectional view of induction heating apparatus of this invention illustrating can ends being moved past the apparatus.

The system which has been selected for purposes of illustration is especially designed for heating can ends which are continuously moved past an induction heating coil to soften a protective coating on at least one face of each can end. Heating the can ends to the softening temperature of the coating relieves the stresses in the coating and closes any cracks which may have formed in the coating during formation of the can ends from coated sheet metal. The apparatus includes an induction heating coil 10 having one or more wraps or windings of copper tubing 12 of elongated configuration with a major axis parallel to the direction of travel of the can ends 14 past the coil and a minor axis transverse to the direction of travel of the can ends. Depending on the particular application, the coil may have any number of windings such as the three windings in coil 10.

Coil 10 is adapted to be connected to a high frequency alternating current generator 16 which will charge the coil with high frequency alternating current. The generator 16 is preferably connected to a source of water, not shown, for circulating water or other coolant through the coil. High frequency alternating current generators are well known and are available on the market as sold by a number of companies such as Lepel High Frequency Laboratories, Inc. and Induction Heating Corporation. Such generators may supply alternating current using frequencies, for example, of approximately 350–450 kilocycles per second for heating can ends and a variety of power ranges depending on the particular application.

As is explained above, passing a high frequency alternating current through the copper coil 10 produces a magnetic field in the area surrounding the tubing in the coil. When a magnetic article is placed in the magnetic field, heat is produced in the article as a result of eddy current losses and/or hysteresis losses (magnetic materials only). The exact nature of the magnetic field and the eddy current losses which produce heat in a metal article are not fully understood. For example, there is no reliable explanation of why the edges of a sheet metal article are heated first when the article is placed in the magnetic field, generally irrespective the position of the edges of the article within the magnetic field. This so-called "edge effect" has heretofore made it very difficult to completely heat sheet metal articles which are moved rapidly past the coil. Instead such articles had to be moved slowly past the coil to provide time for the heat to be conducted throughout the articles. Sheet metal articles have frequently warped, been overheated along their edges or inadequately heated in their center areas.

In accordance with this invention, a core 20 which is made of conductive, non-magnetic, non-ferrous metal such as copper, aluminum, brass, or the like is positioned adjacent the opened center of the coil 10 to overcome the problems inherent in the prior art apparatus. The core 20 is insulated from the coil 10 by a dielectric medium such as an air gap or a plastic material so that the core and coil have no electrical contact therebetween. Although the principle of operation is not fully understood, it has been found that the core 20 affects the location of the maximum flux density in the magnetic field produced by the coil to facilitate controlled transfer of heat into and out of a sheet metal article which is moved past the coil.

The core 20 is preferably made of a non-magnetic, non-ferrous metal so it will cause only a minimum of power loss. If the core were made of ferrous metal, induced currents in the core would produce substantial hysteresis losses in the core. Such hysteresis losses would use power which would otherwise be available for inducing eddy currents in the can ends to be heated. A further effect of hysteresis losses in a magnetic core is that the core would be heated thereby and would have to be cooled to a greater extent than is required for a non-magnetic core. While a non-magnetic core of this invention is heated by eddy current losses, such heating is not nearly as great as the heating produced by both eddy current losses and hysteresis losses in a magnetic core.

Depending on the particular application, the shape and position of core 20 may be selected to accomplish the desired result. In the system which has been selected for illustration, the core 20 is so designed that when a circular can end 14 is moved continuously under the coil and core, the can end will be heated by transfer of heat energy progressively from its outer edge inwardly to its center area, and then causing the flow of heat progressively from its center area outwardly to the outer edge. This ensures complete heating of all areas of the can end without warping the can end.

Figure 2:
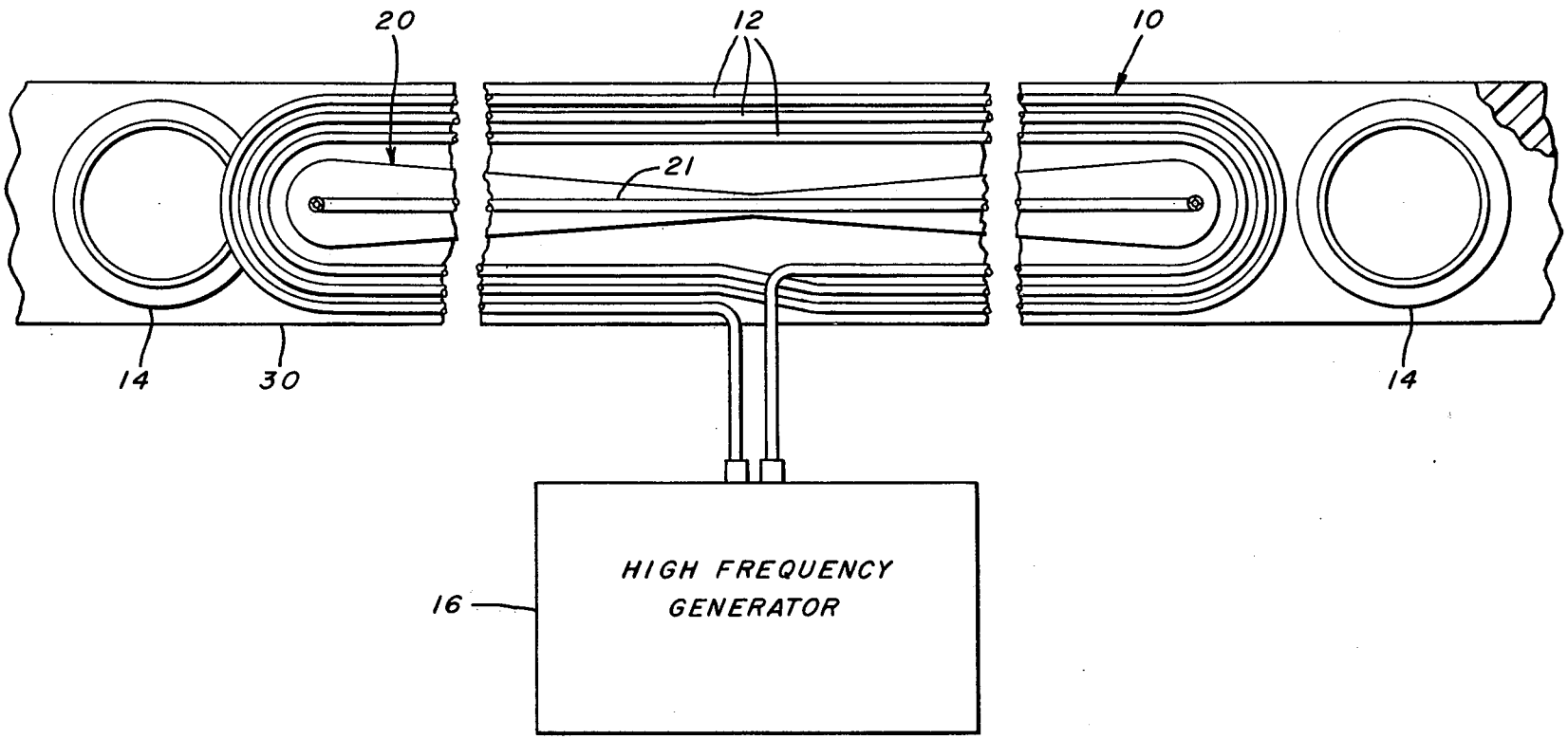
FIG. 2 is a top plan view through the heating coil illustrated in FIG. 1 on a somewhat larger scale.

To effect controlled heating of a can end in the manner described above, the core 20 preferably has a generally bow-tie shape and may be curved with respect to the horizontal plane of coil 10 as is best illustrated in FIG. 2. The end and center of the core are disposed above the coil on the side thereof opposite from the can ends 14 which are heated by the magnetic field, and the intermediate portions of the core are disposed in approximately the plane of the coil. A plurality of adjustable support rods 22 are connected to the core at a number of locations along its length for adjustably supporting the core. These rods 22 facilitate adjustment of the vertical elevation of the entire core or selected portions thereof to adjust the magnetic field produced by the coil. The adjustment rods 22 are mounted on a bar 24 or other support with screws 26 or the like for fixing the height of the rods. Although four such adjustment rods 22 are illustrated in FIG. 1, it will be apparent that any number of such rods may be employed.

The core 20 is preferably hollow or has a copper tube 21 soldered thereto which is connected to a source of water or other coolant for circulation through the core or tube to cool the core. Since the core is positioned in the magnetic field produced by the coil 10, the core will be heated by such magnetic field, and circulation of a cooling medium through the core is desired to control its temperature.

Can ends 14 are moved continuously beneath coil 10 and core 20 by means of a non-metallic belt 30 or other non-metallic conveyor which will not be affected by the magnetic field produced by the induction heating apparatus. The can ends 14 are positioned on the belt with approximately equal spacing between ends, and they are moved by the belt beneath or adjacent the coil in close proximity to the coil and core. The conveyor belt 30 is non-metallic so it will not affect the intensity of the magnetic field produced by the induction heating apparatus, and will not be heated by such magnetic field. It is desirable to maintain the can ends 14 in approximately uniformly spaced relation so the amount of induced current in each can will be the same, and so each can end will receive approximately the same degree of heating. The can ends 14 are preferably spaced apart or otherwise insulated from one another to prevent shorting of the induced current between can ends which can cause burning or other damage to the contacting edges of such can ends.

The induction heating apparatus selected for illustration in FIGS. 1 and 2, comprises a coil 10 made from 3/16 inch diameter copper tubing formed in three loops and having a length of 34 inches and width of 3¼ inches. The core 20 which has been selected for illustration is made from 3/16 inch thick copper plate and is approximately 31½ inches long and 1¼ inches wide at its ends, narrowing to approximately ¼ inch at its center. A copper tube 21 is soldered to the core along its length for circulating of cooling water through the tubing to cool the core. The coil is connected to a high frequency generator having a frequency capacity of 350–450 kilocycles per second, a power capacity of approximately 10 kilowatts and an inductance capacity range of 3–8 microhenrys.

In the operation of the exemplary apparatus, can ends 14 approximately 3 inches in diameter are moved continuously beneath the induction coil 10 and core 20 spaced below the coil approximately ⅛ inch. The can ends are positioned on belt 30 with the "non-public" surfaces of the ends, which will be on the inside of a can, facing the coil and core. The non-public surface of each can end has a coating on it which will be softened by heat induced in the can end. In this application, the ends are heated to a temperature of approximately 350° ± 25° F. The speed of the moving belt 30 can be adjusted to control the length of time that it takes a can end to pass under the heating coil. If the can ends move too slowly, they can be overheated, and if they move too quickly, they will not be adequately heated. The speed of the can ends and the power output of the generator 16 can be adjusted to produce the desired heating of the can ends. For example, using a 10 KW generator, the can ends can be moved beneath the heating apparatus at a rate of approximately 300 per minute producing a pass time of each can end under the coil of approximately 2 second, and using a 20 KW generator the ends can be heated at a rate of approximately 600 per minute (1 second pass time). As stated above, the position of the various portions of the core 20 may be adjusted to produce the desired complete controlled heating of each can end.

As a can end 14 is initially moved beneath the left-hand end of coil 10, the peripheral edge portions of the can end are subjected to the greatest flux intensity of the magnetic field produced by the coil, and such edge portions are heated first. As the can end continues to move beneath the coil, the location of the peak intensity of the magnetic flux is moved inwardly toward the center of the can end to heat the central portion of the end when the end is under the center of coil 10. The heat energy is then caused to flow from the center of the can end outward when the end moves past the center of the coil. The location of the peak intensity of the magnetic field now moves outwardly to the peripheral portion of the end as the can end moves under the righthand portion of the coil. The dynamics of this method of heat transfer makes it possible to impart large quantities of heat energy into thin sheet metal articles at high rates of speed without warping the article.

Figure 4:
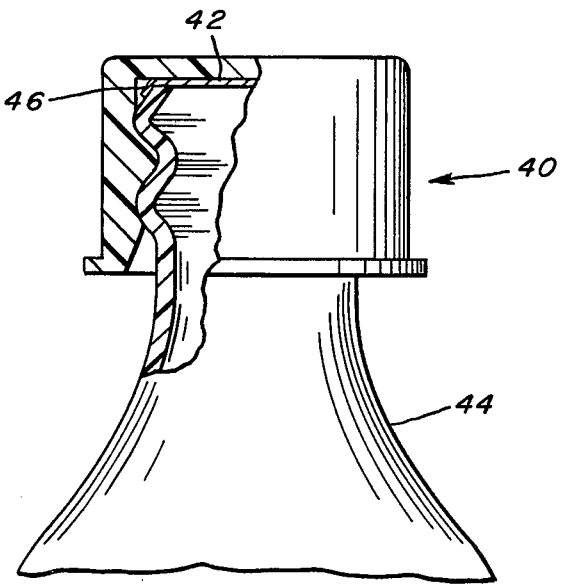
FIGS. 3 and 4 are fragmentary partial cross-sections of closures on containers with foil discs therein which can be heated using this invention to seal the discs on the containers.
Figure 3:
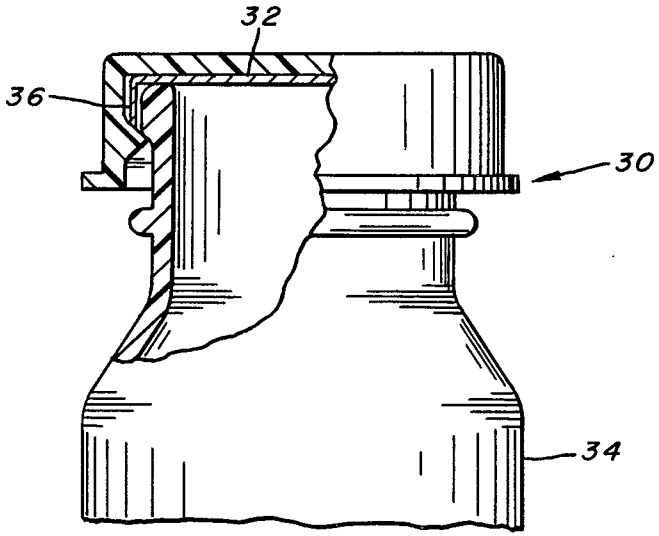

FIGS. 3 and 4 illustrate container-closure assemblies 30 and 40 with foil discs 32 and 42 in them which can be heated using apparatus of this invention to seal the disc on the containers 34 and 44. It is desirable to be able to provide a peripheral flange (36 and 46) on a foil disc to be sealed on the entrance mouth of a container to facilitate gripping by the consumer to strip the disc from the container. Heretofore, induction heating of the foil disc in such assemblies has resulted in burning or overheating of the peripheral edge flange of the disc due to the so-called "edge effect" and other control problems. With this invention, a container-closure assembly such as those illustrated in FIGS. 3 and 4 can be moved rapidly past an induction heating coil and core similar to those illustrated in FIGS. 1 and 2 to heat the disc in the assembly and melt or soften a heat seal resin on the disc to seal the disc on the container finish without burning any portion of the disc.

Figures 5, 6, 7:
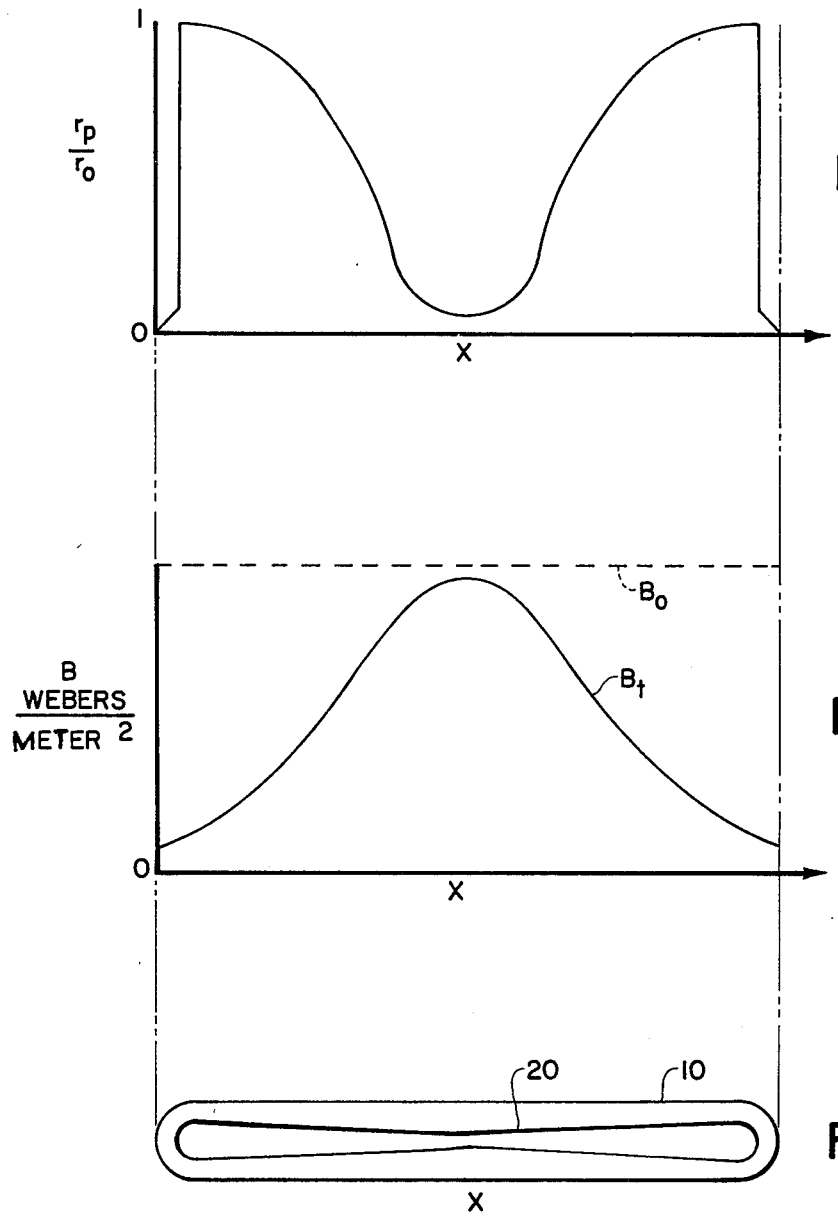
FIG. 5 is a schematic illustration of an induction heating coil and core of this invention with the coil having a length X along its major axis.
FIG. 6 is a graph of $r_p/r_o$ as a function of the position of the can end under the induction heating apparatus of FIG. 5 along the length X of the coil when $r_o$ is the radius of the can end and $r_p$ is the position on the radius of the can end of the peak magnetic flux density.
FIG. 7 is a graph of $B_o$ and $B_T$ as functions of the position of a can end under the coil along the length X of the coil when $B_o$ is the magnitude of maximum magnetic flux density generated by an elongated pancake coil of the prior art and $B_T$ is the magnitude of maximum magnetic flux density generated by an elongated pancake coil and associated core of this invention.

FIG. 5 is a schematic illustration of an induction heating coil 10 and core 20 of this invention. FIG. 6 shows the position on the can end radius of the peak magnetic flux density as a can end is moved along the length X of the coil illustrated in FIG. 5. In such graph, the radius $r_o$ of the can end is constant. The initial and final step in the $r_p/r_o$ curve represents entry and exit of the can end through the minor magnetic fields at the ends of the coil. Once the can end is under the coil, $r_p/r_o$ is essentially 1 since the peak flux density is in the outer edge of the can end so $r_p$ and $r_o$ are approximately equal. As the can end moves toward the center of the coil, the peak flux density moves toward the center of the can end and $r_p$ therefore becomes smaller as does the ratio of $r_p/r_o$. The peak flux density then moves outwardly on the can end radius as the can end moves from the center to the right hand end of the coil. Thus, the ratio of $r_p/r_o$ again increases as illustrated in FIG. 6.

FIG. 7 is a graph of the magnitude of the maximum flux density generated in a can end by a pancake coil of the prior art and by a pancake coil and associated core of this invention. It is seen that as a can end is moved along the length of a pancake coil of the prior art, the magnitude of the maximum flux density generated in the can end is essentially constant. With a coil and core of this invention, the magnitude of the maximum flux density in the can increases as the can end moves toward the center of the coil and then decreases again as the can end moves toward the exit end of the coil.

As a result of the flux patterns produced in a can end as it is moved under apparatus of this invention, the can is uniformly heated throughout without warping it. The leading and trailing edges of the can end are heated as the can end initially moves under the apparatus and again when it exits from under the apparatus. The side edges of the end are heated as it moves along the entire length of the apparatus. The center portions of the can end receive increased heating as the end moves toward the center of the coil and then reduced heating as the end moves from the center of the coil to its exit end. All portions of the can end are thereby heated without heating any one portion to a substantially greater amount than any other portion. Further, the peripheral edge portions, which cool fastest, are the last to receive induced heating. This helps to prevent warpage that occurs when the edge portions cool before the center portion of the end.

Although a preferred embodiment of this invention has been selected for purposes of illustration, it will be apparent that numerous modifications could be made without departing from the invention. For example, the coil and core could be of a variety of shapes and could be used for a variety of purposes. This invention provides means for changing and controlling the peak flux intensity of a magnetic core through an associated conductive core, whether the apparatus be used for annealing, cooking, curing, sealing, or any other use of induction heating.

What is claimed is:

1. Induction heating apparatus comprising a substantially flat high frequency induction heating coil having an elongate configuration with major and minor axes and a generally open center and terminals for electrical connection to a high frequency alternating current generator, and an associated elongate core of substantially non-magnetic, conductive metal disposed generally within the open center of the coil with the major axis of the core substantially aligned at and along the major axis of the coil and insulated from the coil.

2. Induction heating apparatus as set forth in claim 1 which includes means for cooling said care.

3. Induction heating apparatus as set forth in claim 1 which includes means for adjusting the vertical location of said core, or selected portions thereof, to adjust the location and intensity of the electromagnetic field which is produced by the apparatus.

4. Induction heating apparatus as set forth in claim 1 in which said core is bow-tie shaped with wings disposed on opposite sides of a relatively narrow center portion.

5. Induction heating apparatus as set forth in claim 4 in which said core is curved with respect to the general plane of the windings in the coil with the center portion and ends of the core disposed further from the coil than are the intermediate portions of the core on the side of the coil opposite that which will face articles to be heated.

6. A method of heating metal articles comprising moving metal articles through a magnetic field produced by a high frequency induction heating coil to initially expose the peripheral portions of each article to the greatest flux intensity as the article is induced into the magnetic field, followed by exposing the article to the greatest flux intensity progressively inwardly to the center of the article as the article is moved into the center of the magnetic field, then exposing the article to the greatest flux intensity progressively outwardly to the peripheral portions of the article until it exits the magnetic field and continuously exposing the lateral edge portions of the article to the magnetic field as it is moved through the magnetic field.

7. A method of heating a metal article without warping it by moving the article through a magnetic field to heat the leading and trailing edges of the article when it is introduced into the magnetic field, followed by heating the center portions of the article as it is moved through the magnetic field followed by again heating the leading and trailing edges of the article as it exits the magnetic field while continuously heating the lateral edge portions of the article as it moves through the magnetic field.

8. A method as set forth in claim 7 in which the article comprises a metal can end which is heated to soften a plastic coating on at least one side thereof.

9. A method as set forth in claim 7 in which said article comprises a metal foil disc in a container-closure assembly which is moved through the magnetic field to heat such disc and a heat seal resin thereon to seal the disc to the container mouth.

10. Induction heating apparatus as set forth in claim 1 in which said core is made of a strip of copper approximately 3/16 inch thick.

11. Induction heating apparatus as set forth in claim 1 in which said coil is a flat pancake coil having at least two windings.

* * * * *